United States Patent [19]

Drellich

[11] Patent Number: 4,601,161

[45] Date of Patent: Jul. 22, 1986

[54] LEG UP STRAP

[76] Inventor: Ronald H. Drellich, 2131 N. 61st Ave., Hollywood, Fla. 33024

[21] Appl. No.: 698,232

[22] Filed: Feb. 4, 1985

[51] Int. Cl.[4] ..... B68C 1/16

[52] U.S. Cl. ..... 54/46

[58] Field of Search ..... 54/1, 23, 46, 47

[56] References Cited

U.S. PATENT DOCUMENTS

| | | | |
|---|---|---|---|
| 255,334 | 3/1882 | Reister | 54/45 |
| 1,183,843 | 5/1916 | Badger | 54/46 |
| 2,252,257 | 8/1941 | Harvey | 54/1 |
| 2,937,023 | 5/1960 | Seymour et al. | 119/109 X |
| 4,019,463 | 4/1977 | Kitchen | 119/153 X |
| 4,398,500 | 8/1983 | Koronkiewicz | 119/109 |

*Primary Examiner*—Robert P. Swiatek

*Attorney, Agent, or Firm*—Robert Schwartz; Edward I. Mates

[57] ABSTRACT

The present invention relates to apparatus for assisting a short or weak person to mount a horse or other four legged animal. In addition, the apparatus may be used as a soft seat and bridle or halter after the person has mounted the horse and is ready to ride, and for many other uses described in the accompanying specification.

20 Claims, 5 Drawing Figures

LEG UP STRAP

FIELD OF THE INVENTION

The present invention relates to apparatus for mounting a horse, or other four legged animal, and, particularly, to apparatus that enables a person of short stature, or one who is not strong enough to mount it by jumping onto the horse, to mount a horse when the horse is bareback. The present apparatus has several other uses that will be described in the specification that follows.

BACKGROUND OF THE INVENTION AND DESCRIPTION OF PATENTS OF INTEREST

Traditionally, horses have been mounted by providing a pair of stirrups suspended from opposite sides of a bare backed horse or one fitted with a saddle fixed over the back of a horse, usually by a flank strap that extends from the saddle to encircle the body of the horse. Children and other riders of short stature have stood on blocks or posts so that a rider could lift one of his or her legs to bring the corresponding foot into engagement with one of the stirrups on one side of the horse (usually the left side) and swing the other leg over the back of the horse until the rider was mounted in sitting position on the saddle and was able to engage the other foot into the other stirrup. Straps of adjustable length were sometimes used to adjust the elevation of the stirrups from ground level to avoid a need for mounting blocks or posts of different heights for riders of different heights. As an alternative, riders of short stature were boosted by hand by other people to help them mount a horse.

In the past, it was often necessary to have two people assist a rider who was either too short to reach the back of the horse or too weak to jump onto the back of the horse to mount the horse. One person held the horse and another person boosted the rider onto the horse.

When a horse is to be ridden bare-backed, the problem of mounting becomes more complicated because of the absence of a saddle to support stirrups therefrom. Typically, a rider jumps over the back of the horse to be mounted and leans across the horse to place the stomach of the rider across the back of the horse so that the head of the rider extends sideways beyond one side of the back of the horse and the feet of the rider extend sideways beyond the other side of the horse. The rider must clamber awkwardly from the stomach-down prone position to an upright sitting position.

Some horses without saddles have been equipped with a flank strap from which stirrups are suspended. However, as soon as a rider engages a stirrup so arranged while mounting the horse, the weight of the rider causes the flank strap and stirrups to slide around the body of the horse from their proper orientation. Thus it becomes difficult, if not impossible, for a rider to obtain a balanced sitting position with both feet engaging both stirrups at equal heights above the ground under such circumstances.

To the best of my knowledge, no one has devised a solution to the previously mentioned problems.

British Pat. No. 299, 106 to Roberts provides a temporary auxiliary means for mounting an animal in the form of a hunting crop or whip having a rigid L-shaped handle. This patented invention is characterized by adapting a flexible part of the crop or whip to be passed through a stirrup and connected in an easily detachable manner to the handle of the whip. When attached to the stirrup, the rigid L-shaped handle of the detachable whip serves as an auxiliary stirrup closer to ground level than the ordinary stirrup, thereby enabling a shorter rider to mount the animal than one who is tall enough to use the ordinary riding stirrup. When detached from the ordinary riding stirrup, the whip can resume its normal function. This patent requires the use of ordinary stirrups that are attached to a saddle or a flank strap to provide support for the whip when the latter serves as an auxiliary stirrup. No mention is made in this patent of avoiding the need for a flank strap to secure a saddle or stirrups to the body of the animal.

U.S. Pat. No. 2,252,257 to Harvey discloses a combination flank strip and cinch girth that is readily releasable from its usual operating position surrounding a bucking bronco to avoid the hazardous operation of unfastening the flank strap while it is attached to the horse. The apparatus of this patent cannot operate in the absence of a flank strap portion that extends across and under the body of a horse.

U.S. Pat. No. 2,812,123 to Girton discloses a multipurpose gun sling which may also be used as a short leash on an animal such as a hunting dog, or on a child to retain either of them close and under the control of an adult. In another embodiment, the potential device may be used as a tourniquet. The sling comprises a flexible strap folded back on itself at both ends to form a loop at each end of the strap. Means is provided to adjust the size of each loop individually. This patent does not teach how to modify any of its embodiments to enable its use as a leg up strap to assist a peson to mount a horse.

BRIEF DESCRIPTION OF THE PRESENT INVENTION

The present invention comprises a flexible leg up strap having a first loop portion placed around the foreleg of a horse on the side opposite its mounting side and raised up to its body or shoulder. Optionally, a layer of padding may be provided on the interior curcumference of the first loop portion to avoid hurting the shoulder of the horse when the first loop portion is so applied. A flexible belt connecting portion is fixed at one end to or unitary with said first loop portion and extends over and across the back of the horse. A second loop portion is fixed in adjustable position to the other end portion of said flexible belt connecting portion and hangs downward therefrom on the mounting side of the horse.

When the apparatus is used as a horse mounting assist, the second loop portion serves as an adjustable stirrup. Means is provided to adjust the height of the stirrup above the ground. This height adjustment means may include either means to adjust the circumference of said second loop portion or means to adjust the length of said flexible belt connecting portion or a combination of said latter two adjustment means.

The first loop portion is releaseably fastened to the shoulder of the horse so that after the apparatus is used as an adjustable stirrup to assist a rider to mount the horse, the first loop portion can be readily opened to release the latter from engagement around the leg of the horse below the previously engaged shoulder. The released leg up strap can then be stored by the mounted rider or placed around the neck of the horse to serve as a bridle while another portion of the strap extends down the center of the back of the horse in folded relation to provide a relatively softer seat than the relatively hard spine extending along the uncovered back of the horse.

A layer of soft material, such as felt, lambswool or any soft material, may be incorporated in the flexible belt to provide even a softer seat for the rider. The mounted rider can loop the opened leg up strap around the neck of the horse to form a storage place for the strap while the rider rides the horse.

While this invention is mainly used to mount bareback horses, it also has utility with horses provided with either full saddles or partial saddles extending over the back only of the horse, particularly to keep the saddle in place. In a preferred embodiment of this invention, this object is obtained by circling the right hand shoulder of the horse with one end portion of the strap and securing the other end portion of the strap to the saddle horn or any other convenient connection of the horse to secure the strap to the horse even when force is applied to the strap on the left hand side of the horse.

The second loop portion may be of adjustable circumference. In such case, the second loop portion, in addition to its first described use, may also be used to surround a load and be tightened around the load when the second loop portion is adjusted to be dragged by an animal serving as a beast of burden.

Other uses for the present invention will be described after a description of a specific embodiment of this invention and variations thereof are recited in the portion of this specification that follows.

DESCRIPTION OF DRAWINGS

In the drawings that form part of a description of certain specific embodiments of this invention and variations thereof and wherein like reference numbers are applied to like structural elements illustrated in the drawings.

DESCRIPTION OF ILLUSTRATIVE EMBODIMENTS

Figure 1:
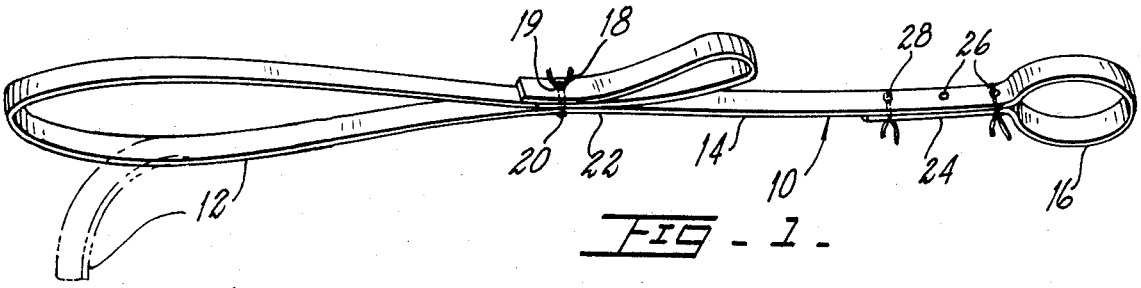
FIG. 1 is a frontal view of a leg up strap conforming to this invention extended to its full length prior to its application to a horse, showing a shoulder surrounding loop portion shown in full lines as a full loop and a fragmentary showing of said latter loop portion in phantom in its disconnected state.

Referring to the drawings, a leg up strap 10 conforming to the present invention comprises a first loop portion 12, a flexible belt connecting portion 14 and a second loop portion 16. One or more lacing means 18 is inserted through one or more eyelets 19 near one end of the first loop portion 12 held together by stud means 20 at one end portion 22 of belt connecting portion 14. It is understood that more or fewer pairs of lacing means 18 and eyelets 19 may be provided to adjust the length of the first loop portion 12 to conform to different sizes of horses as desired. It is also understood that the facing surfaces of the first loop portion 12 and of the belt connecting portion 14 may be covered with a releasable bonding material such as Velcro (Reg. ®) to provide adjustability of the size or circumference of the first loop portion 12. Any other well known adjustment means such as snaps and snap receiving members may be substituted to connect different end portions of the first loop portion 12 and/or of one end portion 22 of the belt connecting portion 14 to one another temporarily in readily disconnectible relation to adjust the length of said leg up strap 10.

The belt connecting portion 14 has another end portion 24 connected to the second loop portion 16 through a plurality of connecting means 26 and 28. The latter may be similar in structure to any one of the sets of lacing means 18, eyelets 19 and stud means 20 or may be any of the constructions described for alternatives of laces 18, eyelets 19 and stud means 20 previously described for adjustably connecting the one end portion 22 of the belt connecting portion 14 to the first loop portion 12. The purpose of connecting means 26 and 28 is to connect the second loop portion 16, which serves as a bridle or halter to the other end portion 24 of the flexible belt connecting portion 14 in any one of several positions so as to fix the vertical position of the lowest portion of the second loop portion 16 above the ground, thereby adjustably fixing the position of the stirrup or bridle loop that the second loop portion 16 forms above the ground. As in the previous cases for the adjustable connection between the first loop portion 12 and the flexible belt connecting portion 14, the number of selectable positions may differ from the number illustrated in the drawings.

Figure 2:
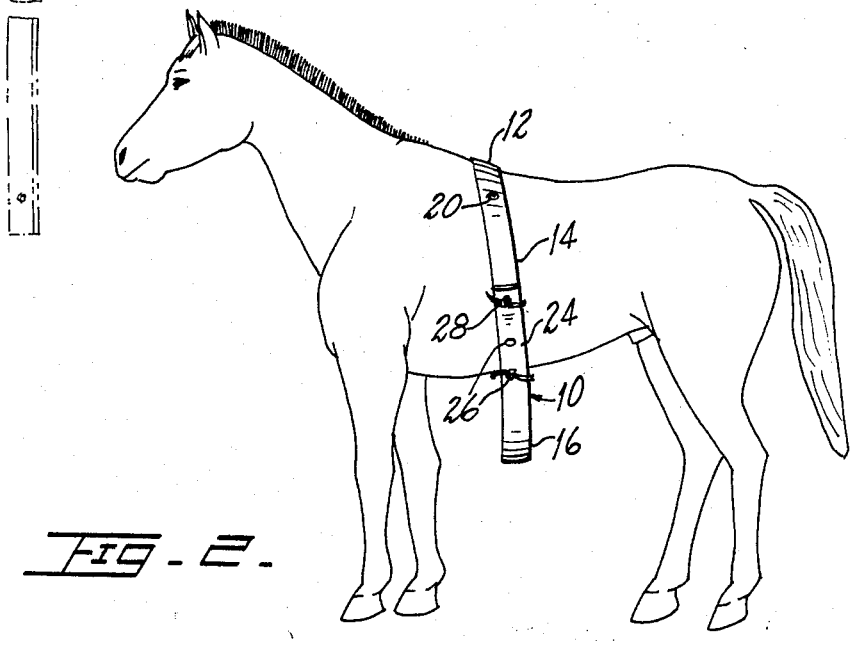
FIG. 2 is a side view of the mounting side of a horse after the leg up strap of FIG. 1 has been applied over the back and around one of legs and shoulders of the horse.
Figure 3:
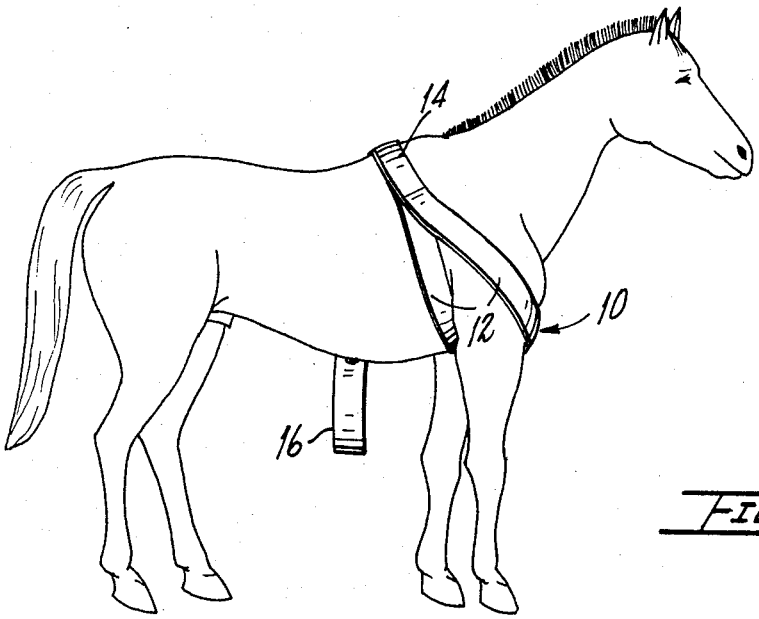
FIG. 3 is a side view of the opposite side of the horse in the same condition as depicted in FIG. 2.

The leg up strap 10 of FIGS. 1 to 3 is applied to a horse to be mounted by adjusting the circumference of the first loop portion 12 to the circumference of the shoulder on the side of the horse opposite the side to be mounted. Since horses are usually mounted from the left side, the right foreleg of the horse is lifted, the first loop portion 12 is placed around the right foreleg of the horse and lifted until the inner circumference of the first loop portion 12 engages and surrounds the right shoulder of the horse. Care should be taken not to pinch the skin of the horse in the vicinity of its right shoulder. The flexible belt connecting portion 14 is thrown across the back of the horse so that the second loop portion 16 hangs from end portion 24 along the left side of the horse. Proper adjustment of the connection or bonding between the second loop portion 16 and end portion 24 establishes the height of the stirrup formed by the lower end of the second loop portion 16 above the ground.

A rider places his left foot into the second loop portion 16 and swings his right leg over the back of the horse to straddle the horse and mount the horse in a sitting position. Since the first loop portion 12 is readily opened, the mounted rider can open the first loop portion 12 so that it assumes the open hanging configuration depicted in phantom in FIG. 1 after the horse is mounted. The rider releases his left foot from the stirrup and pulls up the free hanging leg up strap 10. Further handling of the leg up strap 10 after mounting will be described later.

Figure 4:
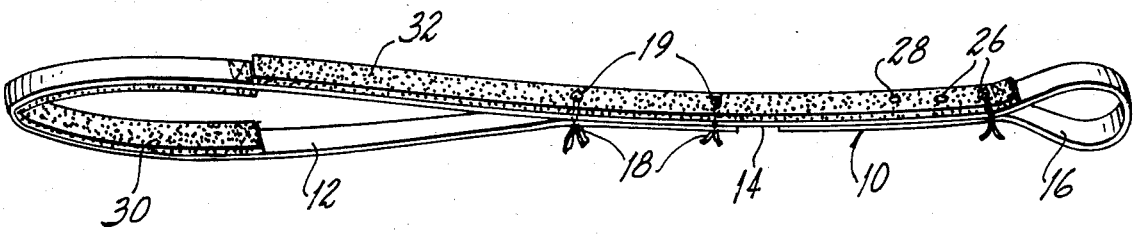
FIG. 4 is a frontal view upside down compared to FIG. 1, of an alternate embodiment of this invention that comprises a leg up strap provided with a padded layer for at least a portion of the interior circumference of the first loop portion and a padded layer for the back engaging surface of the flexible belt connecting portion.
Figure 5:
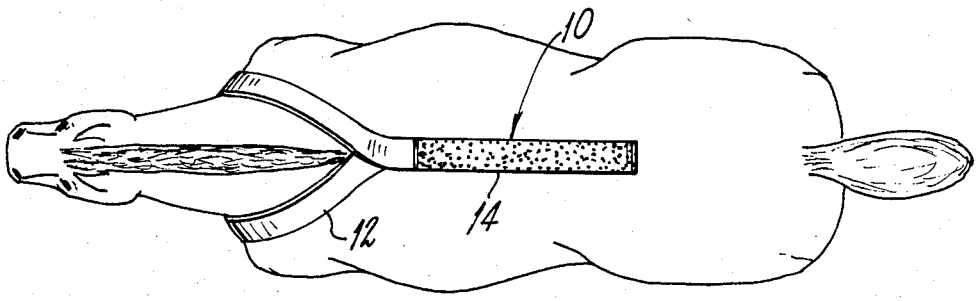
FIG. 5 is a plan view of a horse showing how the leg up strap of the present invention may be stored around the neck and over the sitting area of the back of the horse for use as a seat after the horse is mounted.

The horse can be made comfortable by constructing the leg up strap as depicted in FIG. 4. In this preferred embodiment, at least a portion of the inner circumference of the first loop portion 12 is optionally covered with a layer of padding 30 to enable a relatively soft material to engage the shoulder and upper leg portion of the horse. In addition, the lower surface of the flexible belt connecting portion 14 is optionally covered with a layer of padding 32 that faces the back of the horse when said flexible belt connecting portion 14 is mounted across the back of said horse.

One or more additional pads (not shown) may be inserted between the first loop portion 12 and the shoulder of the horse whenever desired. These pads may be used either with the embodment of FIGS. 1 to 3 or that of FIG. 4.

Once the horse is mounted and the leg up strap 10 is opened and pulled up, it may be stored on the horse by folding the strap 10 except for the first loop portion 12. The latter is looped across the head of the horse and brought back around the neck of the horse while the flexible belt connecting portion 14 and the second loop portion 16 are folded and the folds extended to the rear of the neck of the horse over the horse's back to form a seat many layers thick resting on the sitting area of the back of the horse. The mounted rider will find it easy to reclose the first loop portion 12 to a circumference such that it fits loosely over the neck of the horse and to adjust his sitting position so that the rider sits on the folded seat rather than directly on the back of the horse. The portion of the leg up strap 10 that loosely encircles the neck of the horse can serve as a bridle or halter and avoid the need for the mounted rider to grip the mane of the horse when riding.

The following precautions are suggested in using the leg up strap conforming to the present invention:

1. Avoid irritating the shoulder of the horse by standing in the stirrup formed by the second loop portion 16 for a limited time only, preferably not more than 3 to 4 seconds, depending on the weight of the rider, and avoid stepping back once mounting has started.
2. Avoid putting the rider's foot all the way through the stirrup loop before or during mounting.
3. Avoid having any portion of the leg up strap engage the belly or underside of the horse, which belly is more sensitive than the back of the horse.
4. Avoid installing the leg up strap over the neck or withers of the horse, which is also more sensitive than the back of the horse.
5. Avoid riding the horse until after the leg up strap is removed from its arrangement around the horse established to facilitate mounting.

OTHER USES FOR LEG UP STRAP OF THIS INVENTION

While the leg up strap of the present invention has been described for use by short or weak riders to mount a bareback horse, it is understood that the leg up strap of this invention may be used as well with horses fitted with a partial saddle over the back only or with horses fitted with a full saddle. Furthermore, the leg up strap can be used in horse shows where small or weak people presently have to mount a horse bare back by jumping across and over the back of a horse without assistance from another person so that the rider temporarily lies athwart the horse with his stomach facing the horse's back until the rider clambers awkwardly to a sitting position.

The leg up strap of this invention can be used to support one of the legs of a horse off the ground when the leg of the horse is either broken or sprained and must be suspended in spaced relation to the ground until medical help arrives. The leg up straps may be applied to either back leg that is free of injury and over the rump of the animal to hold any other leg suspended above ground.

A blacksmith can use apparatus conforming to this invention to suspend a leg of a horse on whose foot a horseshoe is to be applied or removed.

The leg up strap of the present invention may be used as a leash to lead a horse or to tie a horse to a tree or post or any sturdy support.

This invention can be used at race tracks to mount small persons, such as jockeys, on horses used for exercise, thereby avoiding the need for someone to give the rider a boost or to mount the horse in the vicinity of a mounting stand or platform.

A set of four leg up straps, each applied to a different one of the four legs of a horse, can be used to lift animals under 1,500 pounds (700 kilograms) by hook or crane into a trailer or, in the case of a survival lift, into a helicopter.

If a horse breaks loose while provided with a leg up strap, the latter facilitates the recapture of the horse.

If a short or weak rider is dismounted from a horse at a distance from the location of its first mounting, the presence of a leg up strap conforming to this invention enables the short or weak rider to remount the horse readily without outside assistance.

It is obvious from the description that once a leg up strap conforming to this invention is applied to a horse, the latter's movement becomes inhibited. Consequently, it is no longer necessary to require one person to hold the horse and another to boost a rider in order for the latter to mount the horse.

Other uses for this invention will be obvious in the light of the foregoing description.

The recital of an illustrative embodiment and variations thereof of this invention in this specification is for the purpose of illustration rather than limitation. It is understood that various changes may be made in the light of the foregoing description without departing from the gist of this invention as defined by the claimed subject matter that follows.

I claim:

1. Apparatus for mounting a horse or other four legged animal comprising a strap having a first loop portion constructed and arranged to fit around the shoulder of said horse on the side opposite the mounting side of said horse, a flexible belt connecting portion extending from one end fixed to said first loop portion over and across the back of said horse to its other end portion down below the mounting side of said horse, and a stirrup fixed to the lower end portion of said flexible belt connecting portion to hang downwardly therefrom to receive a foot of a rider to assist said rider to mount said horse, said apparatus being free of any element engaging the belly of said horse.

2. Apparatus as in claim 1, wherein said stirrup comprises a second loop portion having a free end remote from said flexible belt connecting portion and means connecting or bonding said free end of said second loop member to said flexible belt connecting portion or to a portion of said second loop portion to locate the lower end of said second loop portion a desired distance above the ground.

3. Apparatus as in claim 2, wherein said connecting or bonding means is constructed and arranged to adjust the size of said second loop portion so as to establish the location of the lower end of said second loop portion at a selected one of several possible distances above the ground.

4. Apparatus as in claim 1, further including a layer of padding covering at least a portion of the inner circumference of said first loop portion to enable said layer of padding to engage said leg and shoulder of said horse when said first loop portion is applied to said shoulder and a layer of padding covering the surface of said flexible belt connecting portion that faces the back of said horse when said flexible belt connecting portion is mounted across the back of said horse.

5. Apparatus as in claim 1, further including a pad inserted between said first loop portion and the shoulder of said horse.

6. Apparatus as in claim 1, further characterized by readily detachable means on said first loop portion for readily closing said first loop portion around said shoulder prior to mounting said horse and for readily opening said first loop portion to release the latter from said shoulder after said horse is mounted.

7. Apparatus as in claim 6, further characterized by said first loop portion being mounted to surround the neck of said horse loosely to serve as bridle or halter means and another portion of said strap being mounted in folded relation over the back of said horse to provide a seat for said rider after said rider has used said strap to mount said horse.

8. Apparatus as in claim 6, further including means to adjust the circumference of said first loop portion to provide a comfortable fit around said shoulder of horses of different size.

9. Apparatus as in claim 1, further including means to adjust the length of said flexible belt connecting portion in order to locate the lower end of said stirrup a desired distance above the ground.

10. Apparatus for mounting a horse or other four legged animal comprising a strap having a first loop portion constructed and arranged to fit around the shoulder of said horse on the side opposite the mounting side of said horse, a flexible belt connecting portion extending from one end fixed to said first loop portion over and across the back of said horse to its other end portion down below the mounting side of said horse, and a second loop portion fixed to the other end portion of said flexible belt connecting portion to hang downwardly therefrom and capable of supporting a rider's weight when mounting the horse, said apparatus being free of any element engaging the belly of said horse.

11. Apparatus as in claim 10, further including a plurality of fixing means permitting the selection of any one of said fixing means as the point of connection between said flexible belt connecting portion and said second loop portion.

12. Apparatus as in claim 10, wherein said second loop portion is of adjustable circumference to locate its lower end a desired distance above the ground.

13. Apparatus as in claim 10, further including means to adjust the length of said flexible belt connecting portion in order to locate the lower end of said second loop portion a desired distance above the ground.

14. Apparatus as in claim 10, further including a layer of padding covering at least a portion of the inner circumference of said first loop portion to enable said layer of padding to engage the leg and shoulder of said horse when said first loop portion is applied to said shoulder, and a layer of padding covering the surface of said flexible belt connecting portion that faces the back of said horse when said flexible belt connecting portion is mounted across the back of said horse.

15. Apparatus as in claim 10, further including a pad inserted between said first loop portion and the shoulder of said horse.

16. Apparatus as in claim 10, further characterized by said first loop portion being mounted to surround the neck of said horse loosely to serve as bridle or halter means and another portion of said strap being mounted in folded relation over the back of said horse to provide a seat for said rider after said rider has used said strap to mount said horse.

17. A method of mounting and riding a horse comprising taking a strap having a loop portion at each end, adjusting the circumference of one of said loop portions to conform to a shoulder of said horse, adjusting the length of a flexible belt connecting portion that interconnects said loop portions, lifting a foreleg of said horse to receive said conformed loop portion, encircling said foreleg with said conformed loop portion, raising said conformed loop portion into engagement with the shoulder of said horse, throwing the remainder of said strap across and over the back of said horse so that the other loop portion at the other end of said strap hangs from the flexible belt connecting portion along the other side of said horse with said other loop portion suspended at a level that can be reached by a rider mounting said horse, tightening said strap to secure said adjusted loop portion against the shoulder of said horse without pinching the skin of said horse, engaging a foot of said rider into said other loop portion, and swinging the other leg of said rider over the back of said horse to extend said other leg downward along the side of the horse opposite the side on which said conformed loop portion engages said shoulder.

18. A method as in claim 17, further including applying a pad between said conformed loop portion to be conformed to said shoulder.

19. A method as in claim 17, further including opening said conformed loop portion to release the latter from said shoulder, lifting the strap so released, folding the strap to form a seat, mounting said seat so formed on the back of said horse, and sitting on said seat.

20. A method as in claim 19, further including encircling the neck of said horse loosely with said loop portion conformed to said shoulder, reclosing said conformed loop portion and extending said strap rearward from said neck to said folded seat to form a bridle or halter.

* * * * *